US007638725B2

(12) United States Patent
Aoki et al.

(10) Patent No.: US 7,638,725 B2
(45) Date of Patent: Dec. 29, 2009

(54) SWITCH FOR ELECTRIC POWER TOOL

(75) Inventors: Seiichi Aoki, Kanagawa (JP); Hiroyuki Hirose, Kanagawa (JP)

(73) Assignee: Satori S-Tech Co., Ltd., Tokyo (JP)

( * ) Notice: Subject to any disclaimer, the term of this patent is extended or adjusted under 35 U.S.C. 154(b) by 0 days.

(21) Appl. No.: 12/379,514

(22) Filed: Feb. 24, 2009

(65) Prior Publication Data

US 2009/0211886 A1 Aug. 27, 2009

(30) Foreign Application Priority Data

Feb. 25, 2008 (JP) ..... 2008-042607

(51) Int. Cl.
*H01H 13/02* (2006.01)

(52) U.S. Cl. ..... 200/522; 200/332.2

(58) Field of Classification Search ..... 200/522, 200/329, 332.1, 332.2, 61.85, 43.17; 173/170; 310/50; 361/704
See application file for complete search history.

(56) References Cited

U.S. PATENT DOCUMENTS 4,241,297 A * 12/1980 Piber et al. ..... 318/17
5,380,971 A * 1/1995 Bittel et al. ..... 200/536
6,736,220 B1 * 5/2004 Chan et al. ..... 173/170
6,794,594 B2 * 9/2004 Ching ..... 200/522
7,297,891 B2 * 11/2007 Omori et al. ..... 200/522
7,511,240 B2 * 3/2009 Inagaki et al. ..... 200/522

FOREIGN PATENT DOCUMENTS

JP 2003-109451 4/2003

* cited by examiner

*Primary Examiner*—Michael A Friedhofer
(74) *Attorney, Agent, or Firm*—Wenderoth, Lind & Ponack, L.L.P.

(57) ABSTRACT

A switch for use with an electric power tool equipped with a trigger switch. The trigger switch has first contacts for turning on and off a motor, second contacts for turning on and off a speed controller, and a trigger lever. The first contacts are formed by a first fixed contact formed on a second conductive plate and a first movable contact formed on a swingable movable contact plate located opposite to the first fixed contact. The second contacts are formed by a second fixed contact and a second movable contact mounted opposite to the second fixed contact formed on a first conductive plate. The second movable contact is located around the front end of a slide plate slidably supported on the trigger lever. The second fixed contact and sliding plate portion are arranged parallel to the first fixed contact and the support member.

1 Claim, 6 Drawing Sheets

SWITCH FOR ELECTRIC POWER TOOL

BACKGROUND OF THE INVENTION

1. Field of the Invention

The present invention relates to a switch for an electric power tool equipped with a trigger switch and, more particularly, to a switch for an electric power tool which includes an internal switch mechanism having an improved contact structure.

2. Prior Art

The prior art switch for an electric power tool has a trigger lever 100 and a movable contact plate 104 as shown in FIG. 8A The lever 100 has a trigger button 101 at its one end. A spring-biased slider 102 is mounted at the other end. The movable contact plate 104 makes a seesaw motion about a small support member 103. A movable contact 104*a* is mounted at the front end of the movable contact plate 104 and can be brought into and out of contact with a fixed contact 106 located opposite to the movable contact 104*a*. The movable contact plate 104 has a sliding surface 104*b* warped upward. When the trigger button 101 is pulled in, the slider 102 slides on the sliding surface 104*b* and passes beyond the support member 103, at which point the slider begins to move toward the fixed contact 105. If the slider moves further toward the movable contact 104*a*, the slider swings. As a result, the movable contact 104*a* at the front end comes into contact with the fixed contact 105 (see FIGS. 8B and 8C).

As shown in FIG. 8D, if the trigger button 101 is further pulled in, the slider 102 further moves on the sliding surface 104*b* toward the movable contact 104*a*. This further stabilizes the pressure contact of the movable contact 104*a* with the fixed contact 105. This is a so-called full stroke condition. In this state, electric power supplied to the motor can be maximized in a state of switching on of the power supply circuit When the trigger button 101 is ceased to be pulled in, the trigger lever 100 moves in the reverse direction, separating the contacts from each other. As a result, the initial state shown in FIG. 8A is regained.

However, the prior art trigger switch described above has the following problem. The slider 102 sliding on the upper surface of the movable contact plate 104 making a seesaw motion is made of a plastic. That is, the slider 102 is a resinous push member. As the sliding motion is repeated, the slider wears down, reducing the pressure of contact. This results in troubles including adhesion. Consequently, it has been impossible to maintain the pressure of contact constant.

SUMMARY OF THE INVENTION

Accordingly, it is an object of the present invention to provide a switch for an electric power tool which adopts a mechanism not suffering any wear, which would have been heretofore induced by the use of a push member (such as a slider), as a movable contact making contact with a fixed contact.

The above object is achieved in accordance with the teachings of the present invention by a switch for use with an electric power tool having an electric motor and a trigger switch, the trigger switch being disposed in the grip portion of the power tool. The trigger switch includes an insulative enclosure, first contacts for turning on and off the motor, second contacts for turning on and off a speed controller, a trigger lever having one end located outside the insulative enclosure, and a trigger button mounted at the one end of the trigger lever. The insulative enclosure includes a boxlike chassis and a cover mounted over an open side of the chassis and dosing off the open side. The trigger lever makes sliding motion to turn on and off the first and second contacts. The first contacts, the second contacts, and the trigger lever are arranged in the insulative enclosure. Plural conductive plates including first and second conductive plates are mounted and disposed in the chassis of the insulative enclosure. The first contacts for turning on and off the motor are formed by a first fixed contact and a first movable contact located opposite to the first fixed contact that is mounted on the second conductive plate. The first fixed contact is disposed to face the open side of the chassis. The first movable contact is mounted on one movable contact plate swingably supported. The second contacts for turning on and off the speed controller are formed by a second fixed contact and a second movable contact located opposite to the second fixed contact that is mounted on the first conductive plate. The second fixed contact is disposed in a direction perpendicular to the open side. The second movable contact is mounted near a front end of a slidably supported slide plate that is mounted to the trigger lever. A third conductive plate is mounted in the chassis and has a small support member disposed thereon. The support member supports the movable contact plate. A fourth conductive plate is mounted in the chassis and has a sliding plate portion disposed thereon. The second fixed contact and the sliding plate portion are arranged parallel to the first fixed contact and the support member. The trigger lever covers the movable contact plate and the sliding plate portion after being inserted through the opening in the chassis, is located among the movable contact plate, the sliding plate portion, and the cover, and is capable of sliding along an open side of the chassis. The slide plate has a front-end portion coming into contact with the sliding plate portion. The second movable contact is mounted on the front-end portion. The slide plate is mounted by applying biasing force in a sliding direction and in a direction in which the slide plate comes into abutment with the sliding plate portion. A slider sliding on the movable contact plate and swinging the movable contact plate is mounted in a position adjacent to the slide plate.

According to the present invention, the direction of motion of the second movable contact making contact with the second fixed contact is brought into coincidence with the direction (herein referred to as the sliding direction) in which the trigger lever slides. Consequently, the slide plate having the second movable contact follows the trigger lever in the sliding direction. As a result, it is possible to remove the disadvantage that contact of the movable contact induces wear.

BRIEF DESCRIPTION OF THE DRAWINGS

FIGS. 7A-7D are side elevations of movable contacts and fixed contacts mounted on the slide plate, showing the positional relationship of the contacts assumed depending on some degrees to which the trigger lever has been pulled in; and FIGS. 8A-8D are side elevations of movable and fixed contacts mounted on a slide plate, showing the positional relationships among the contacts assumed depending on some degrees to which the prior art trigger switch has been pulled in.

DETAILED DESCRIPTION OF THE PREFERRED EMBODIMENTS

Figure 1:
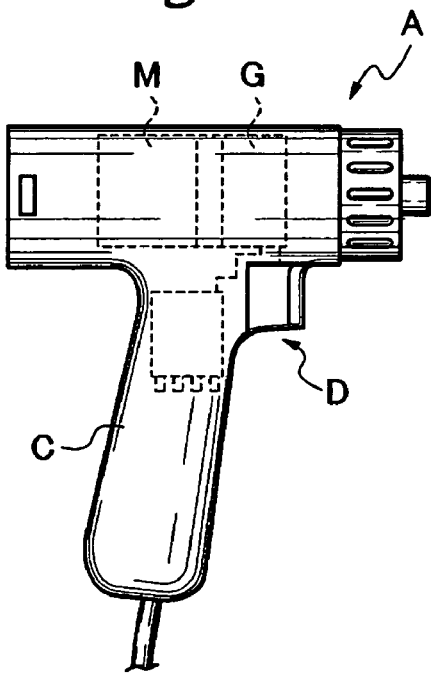
FIG. 1 is a perspective view in side elevation of an electric power tool having a trigger switch according to the present invention.

A switch for use with an electric power tool according to the present invention has an electric motor M and a reduction gear G as shown in FIG. 1. The power tool, indicated by A, has a grip portion C in which a trigger switch D is mounted.

Figure 2:
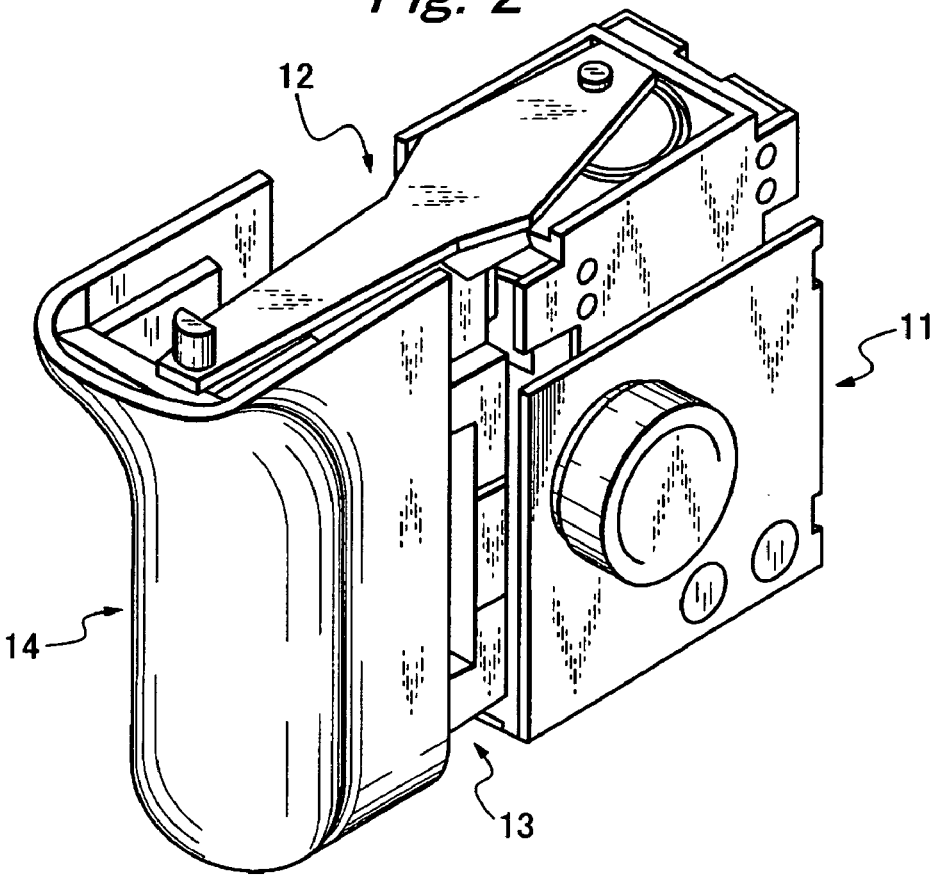
FIG. 2 is a perspective view of the trigger switch, showing its outer appearance.

The shown trigger switch D is used to control the motor M that is the power source of the power tool A The trigger switch is designed to include a selector switch for switching the direction of rotation of the motor M and a speed control circuit for controlling the speed of the motor M. As shown in FIG. 2, an insulative enclosure 11 has an upper surface on which a selector lever 12 is disposed. A trigger lever 13 protrudes from the front side. A trigger button 14 is attached to the front end of the lever 13.

Figure 3:
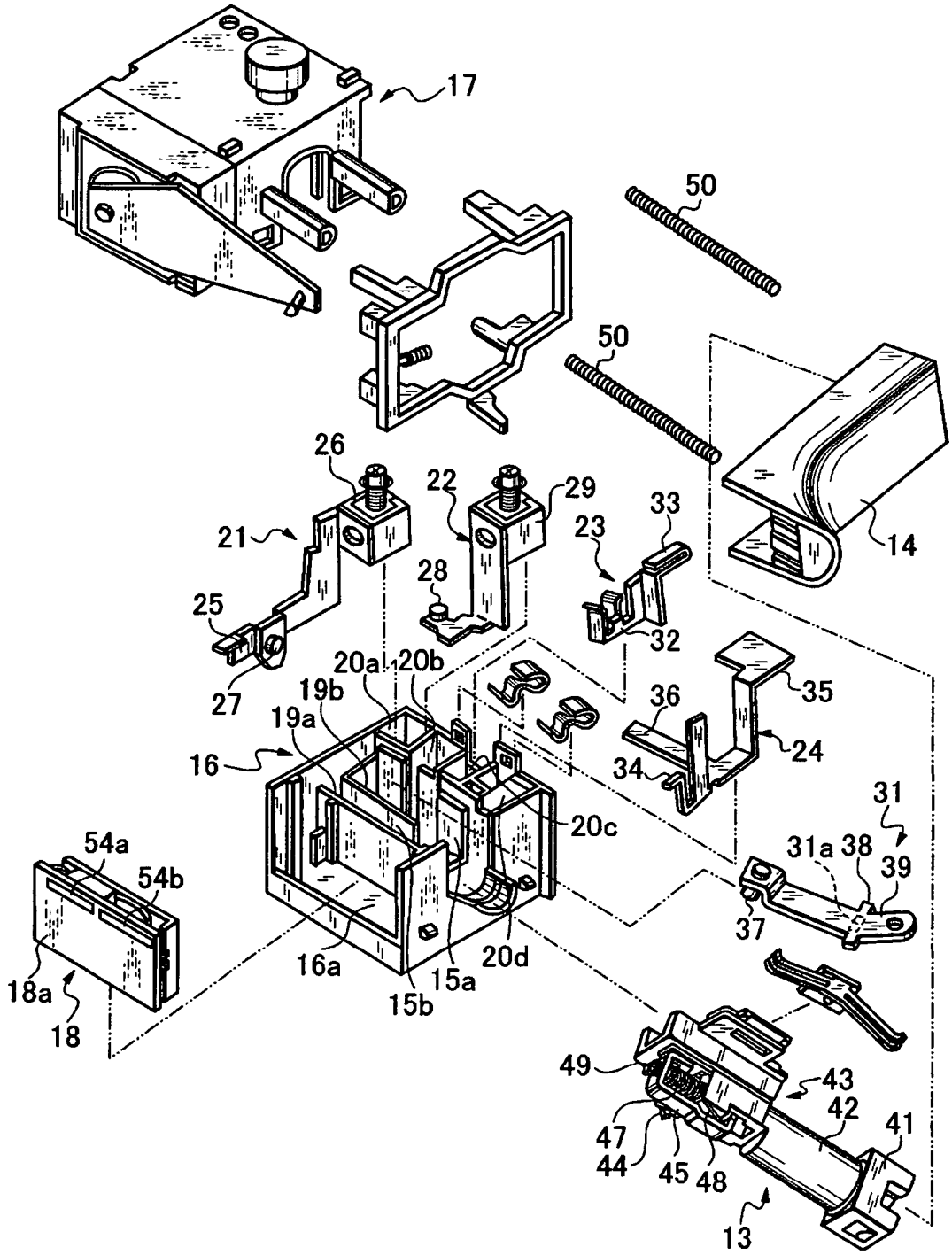
FIG. 3 is an exploded perspective view of the trigger switch, showing the positional relationships among components forming the switch.

Referring to FIG. 3, the insulative enclosure 11 consists of a boxlike chassis 16 and a cover 17 that covers openings on one side and topside of the chassis 16. The boxlike chassis 16 has a circuit board-holding portion 16*a* in the side opening. A circuit board module 18 shaped in the form of a rectangular parallelepiped is mounted and disposed in the circuit board-holding portion 16*a*. A portion that is adjacent to the circuit board-holding portion 16*a* and partitioned from it by a partition wall 19*a* forms a second contact portion 15*b* that moves in the sliding direction and brings contacts into contact A portion that is adjacent to the second contact portion 15*b* and partitioned from it by a partition wall 19*b* located beside the second contact portion 15*b* forms a first contact portion 15*a* that makes a seesaw motion to thereby perform an operation for bringing the contacts into contact A first conductive plate-holding portion 20*a* is formed in a position adjacent to the first contact portion 15*a* and located in the space in the left corner. A first conductive plate 21 is disposed in the first conductive plate-holding portion 20*a*. A second conductive plate-holding portion 20*b* is formed in a space adjacent to the space in the left corner, and a second conductive plate 22 is disposed in the second conductive plate-holding portion 20*b*. A third conductive plate-holding portion 20*c* is formed in a space adjacent to the second conductive plate-holding portion 20*b*, and a third conductive plate 23 is disposed in the third conductive plate-holding portion 20*c*. A fourth conductive plate-holding portion 20*d* is formed in a space adjacent to the third conductive plate-holding portion 20*c*, and a fourth conductive plate 24 is received and disposed in the fourth conductive plate-holding portion 20*d*.

Figure 4:
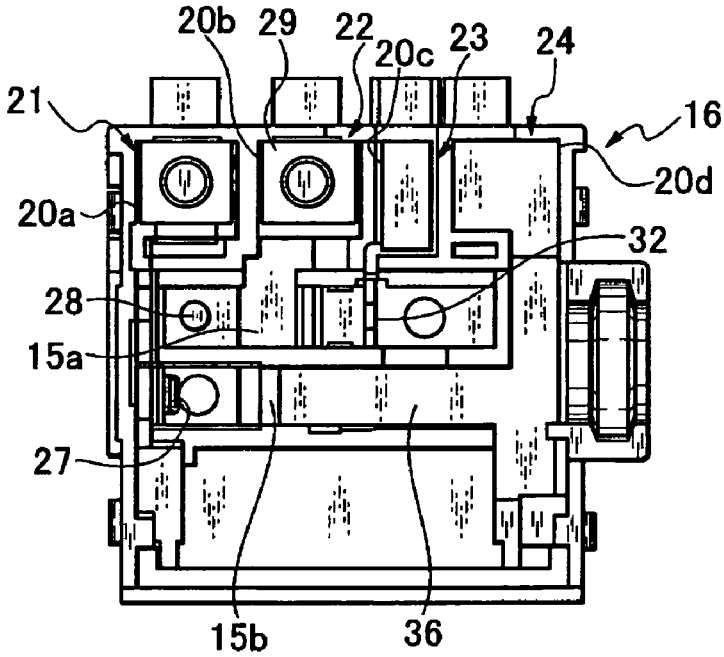
FIG. 4 is a plan view of the trigger switch, showing the manner in which conductive plates are mounted in the chassis of the trigger switch.
Figure 5:
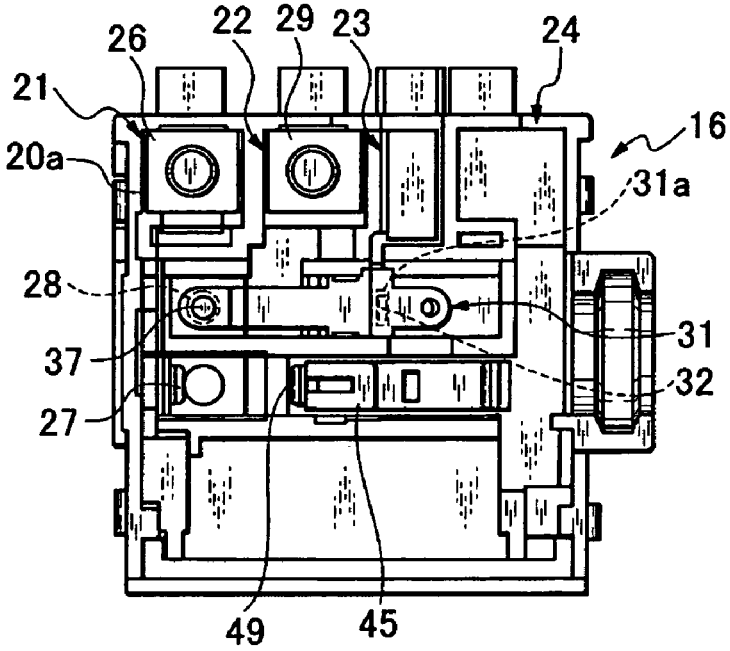
FIG. 5 is a plan view of the trigger switch, showing the manner in which a movable contact plate and a slide plate are also mounted in the chassis.

As shown in FIGS. 3,4 and 5, the first conductive plate 21 received in the first conducive plate-holding portion 20*a* has a board connection portion 25 at its one end extending from the bottom surface. The board connection portion 25 is connected with a circuit board 18*a* of the circuit board module 18. The first conductive plate 21 further includes a connector terminal 26 at its opposite end, the terminal 26 being connected with an external line. In addition, the first conductive plate 21 has a second fixed contact 27 facing an opening formed in the board connection portion 25 in a perpendicular relation to the opening.

When the first conductive plate 21 of the structure described so far is received and disposed in the first conductive plate-holding portion 20*a*, the second fixed contact 27 is arranged to face in the sliding direction while being sandwiched between the left wall surfaces of the second contact portion 15*b*.

As shown in FIGS. 3, 4, and 5, the second conductive plate 22 received in the second conductive plate-holding portion 20*b* has a first fixed contact 28 at one end of the bottom surface, the fixed contact 28 facing the opening. The second conductive plate 22 has a connector terminal 29 at the opposite end, the terminal 29 being connected with an external line.

When the second conductive plate 22 of this structure is received and disposed in the second conductive plate-holding portion 20*b*, the first fixed contact 28 mounted at the front end of the terminal is arranged to face upward from the bottom surface of the first contact portion 15*a*.

The third conductive plate 23 received in the third conductive plate-holding portion 20*c* has a small support member 32 at its one end, the member 32 supporting a movable contact plate 31 as shown in FIGS. 3,4, and 5. Additionally, the third conductive plate 23 has a connector terminal 33 at its opposite end.

When the third conductive plate 23 of this structure is received and disposed in the third conductive plate-holding portion 20*c*, the support member 32 by which the movable contact plate 31 is swingably supported is disposed around the center of the bottom of the first contact portion 15*a*.

The fourth conductive plate 24 received in the fourth conductive plate-holding portion 20*d* has a circuit board connection portion 34 at its one end, the connection portion 34 being connected with the circuit board 18*a* of the circuit board module 18 as shown in FIGS. 3, 4, and 5. In addition, the fourth conductive plate 24 has a connector terminal 35 at the opposite end. The fourth conductive plate 24 further includes a sliding plate portion 36 which extends in a perpendicular direction nearly at the midway position and which makes a surface contact with a slide plate 45.

When the fourth conductive plate 24 of this structure is received and disposed in the fourth conductive plate-holding portion 20*d*, the sliding plate portion 36 shaped like an elongated rectangular plate is disposed such that its surface faces upward on the bottom surface of the second contact portion 15*b*.

The circuit board connection portions 25 and 34 that are at the front ends of the first conductive plate 21 and fourth conductive plate 24, respectively, are soldered and connected to the circuit board 18*a* of the circuit board module 18.

The movable contact plate 31 is used to turn on and off the application of a load as shown in FIG. 3. The movable contact plate 31 is a member in the form of an elongated rectangular plate that has the first movable contact 37 at its front end. A support shaft 31*a* is formed at a position located slightly behind the center position and has convex portions 38 protruding from its both sides. A recess is formed on the rear side of the convex portions 38. When a seesaw motion is produced, the support shaft 31*a* forms the center of the motion. A sliding surface 39 warping upward and rearward from the support shaft 31*a* is formed. The movable contact plate 31 shaped in this way is supported with the support shaft 31*a* in the recess by the support member 32 of the third conductive plate 23. As a result, the movable contact plate 31 is swingably mounted to the chassis 16. The direction in which the movable contact plate 31 swings is set to be perpendicular to the side having the opening in the chassis 16 in the figures. The movable contact plate 31 can be mounted simply by inserting it from the opening in the chassis 16 and placing the contact plate in position.

Figure 6:
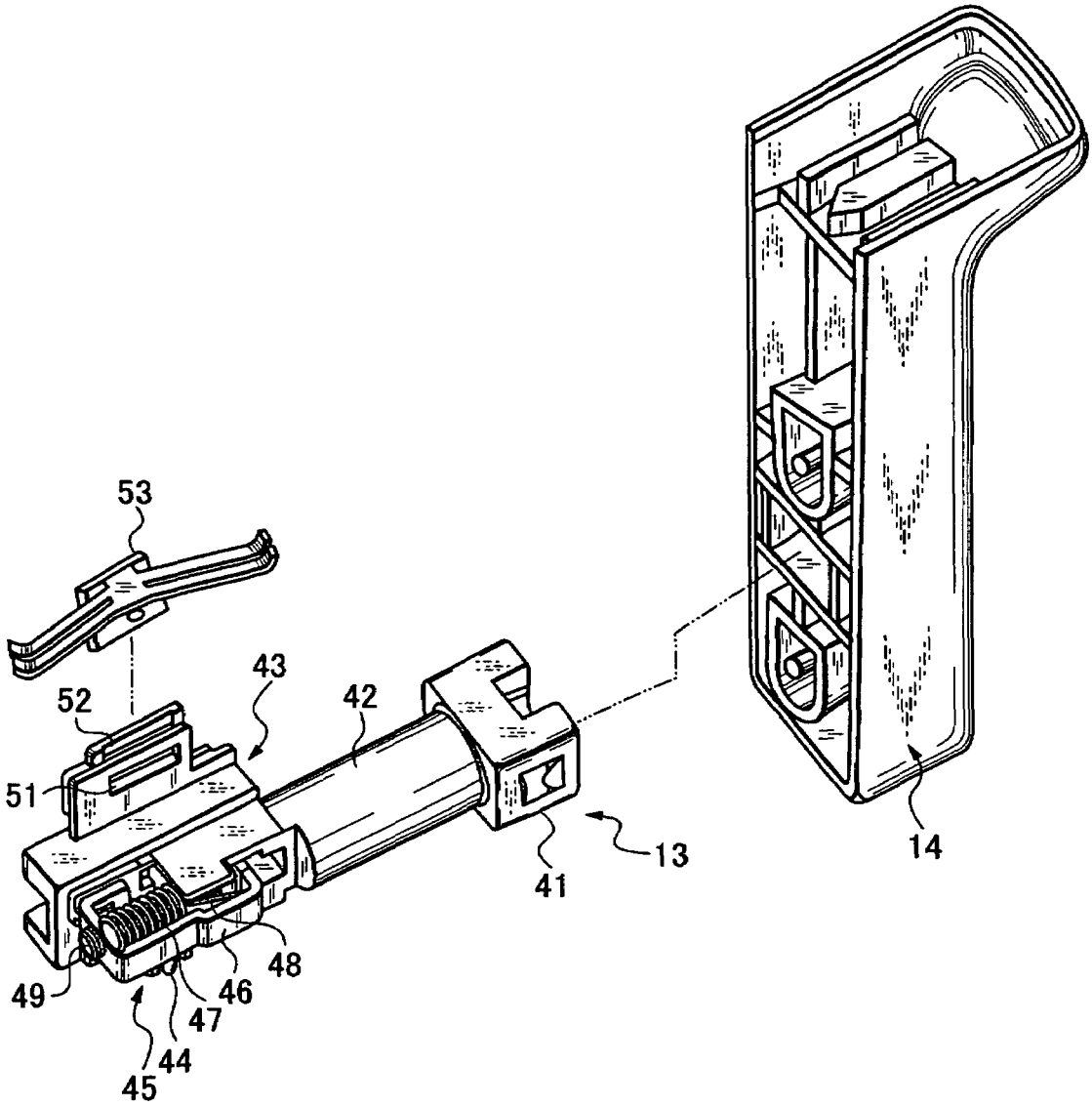
FIG. 6 is an exploded perspective view of a trigger lever having the slide plate and a trigger button.

As shown in FIGS. 3 and 6, the trigger lever 13 having the trigger button 14 at its one end includes a button connection portion 41 at this one end. The connection portion 41 with which the trigger button 14 is to be connected is shaped like the letter U. A cylindrically shaped connecting portion 42 is mounted contiguously with the button connection portion 41. A drive portion 43 in the form of a rectangular parallelepiped is mounted contiguously with the connecting portion 42. A slider 44 sliding parallel to the sliding direction on the movable contact plate 31 is mounted on the bottom surface of the drive portion 43. The slide plate 45 is mounted in a parallel relationship to the slider 44 and has a U-shaped top portion on which a second movable contact 49 is mounted. One leg of the U-shaped top portion extends and forms a leg surface 46 in sliding abutment with the sliding plate portion 36 of the fourth conductive plate 24. A helical slide spring 47 is held in the slide plate 45 to bias it in the sliding direction. A slide plate spring 48 is engaged to the slide plate 45 such that the surface 46 of the slide plate 45 in abutment with the sliding plate portion 36 of the fourth conductive plate 24 makes a sliding motion on the sliding plate portion 36.

The trigger lever 13 is slidable along the side of the chassis 16 having the opening relative to the insulative enclosure 11. Return springs 50 (see FIG. 3) are disposed between the lever 13 and the sidewall of the chassis 16 to bias the lever 13 in a direction to protrude the trigger button 14. As shown in FIGS. 3 and 6, a bladelike surface 51 is formed on a surface of the trigger lever 13 that is adjacent to a surface different from the surface having the slide plate 45. The lever 13 has a contact spring attachment portion 52 by which a contact spring 53 is mounted to an end of the bladelike surface 51.

The contact spring 53 makes contact with segments of a pattern, 54*a* and 54*b*, (see FIG. 3) on the circuit board 18*a* of the circuit board module 18 of the speed control circuit to form a variable resistor.

In this embodiment, the trigger lever 13 held between the chassis 16 of the insulative enclosure 11 and the cover 17 can be mounted by placing the lever into position from the open side of the chassis 16 and then putting the cover 17 from above the lever in the same way as the movable contact plate 31. As the trigger lever 13 mounted in this way makes a sliding motion, the contact point of the slider 44 on the surface of the movable contact plate 31 passes across the position of the support member 32, thus causing the movable contact plate 31 to swing (make a seesaw motion) about the support member 32. Consequently, the first movable contact 37 mounted on the movable contact plate 31 is brought into and out of contact with the first fixed contact 28.

Similarly, as the slide plate 45 arranged parallel to the slider 44 slides, the slide plate slidingly moves on the sliding plate portion 36 while held in abutment with the sliding plate portion 36, and the second movable contact 49 mounted at the front end of the slide plate 45 as viewed in the sliding direction can come into contact with the second fixed contact 27.

As shown in FIG. 3, the circuit board module 18 has the segments of a pattern, 54*a* and 54*b*, on its rear surface. Devices and a heat sink are mounted on the front surface. The module is inserted through the open topside of the chassis 16 and placed in position in the circuit board-holding portion 16*a*. When the module is inserted and placed in position in the circuit board-holding portion 16*a*, board connection portions 25 and 34 of the first conductive plate 21 and fourth conductive plate 24, respectively, arranged on the chassis 16 are engaged in soldering holes formed in the circuit board 18*a*.

After the first through fourth conductive plates 21-24 described so far have been mounted on the chassis 16, the circuit board module 18 is inserted through the open topside. The board connection portions 25 and 34 of the first and fourth conductive plates 21 and 24, respectively, are mounted to the soldering holes by soldering. The movable contact plate 31 is inserted through the side opening. The trigger lever 13 is mounted from above the contact plate 31. The cover 17 is placed over the lever; thus completing the assembly.

In this structure, motion of the second movable contact 49 mounted to the slide plate 45 is described by referring to FIGS. 7A-7D.

Figure 7A:
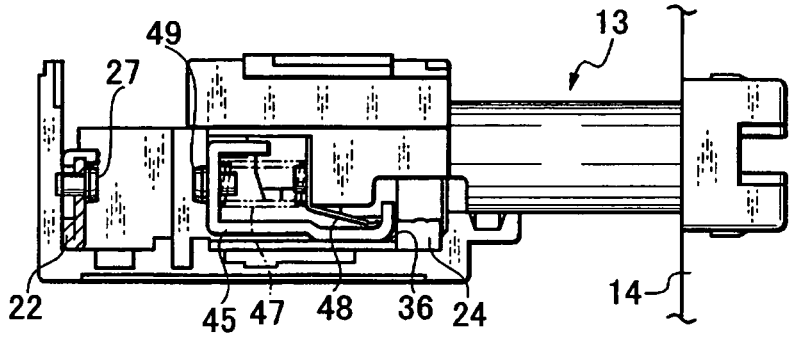

First, as shown in FIG. 7A, the slide plate 45 is biased into abutment against the sliding plate portion 36 by the slide plate spring 48. Furthermore, the slide plate 45 is urged forwardly in the sliding direction by the slide spring 47. Under this condition, the slide plate 45 is in a standby mode. At this time, the second movable contact 49 mounted at the front end of the slide plate 45 is located opposite to the second fixed contact 27.

Figure 7B:
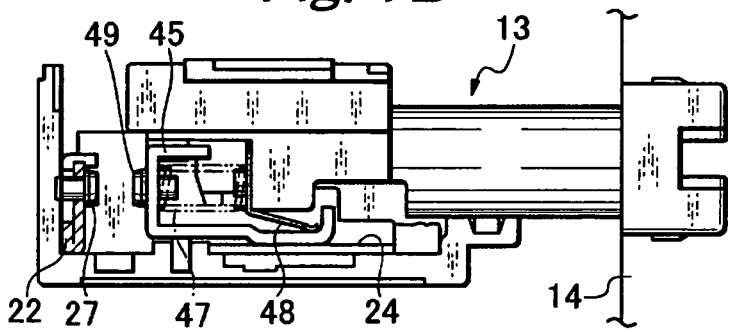

Then, as shown in FIG. 7B, when the trigger button 14 interlocking with the trigger lever 13 is pulled in, the lever 13 slidingly moves in the leftward direction as viewed in the figure. Then, the slide plate 45 in abutment with the sliding plate portion 36 slides, and the second movable contact 49 moves toward the second fixed contact 27.

Figure 7C:
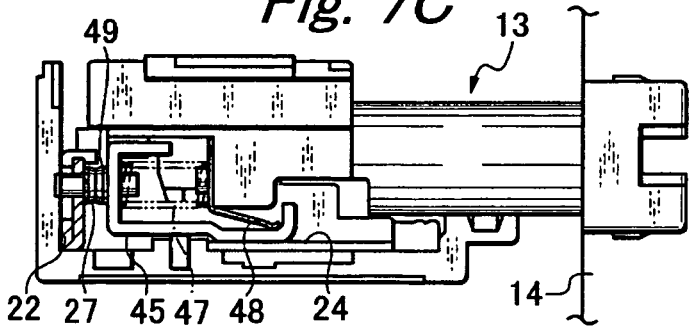

When the trigger button 14 interlocking with the trigger lever 13 is further pulled in as shown in FIG. 7C, the lever slides further in the leftward direction as viewed in the figure. Then, the second movable contact 49 located opposite to it makes contact with the second fixed contact 27 from the front side. At this time, the slide plate 45 is biased by the slide spring 47 and so the second movable contact 49 fitted to the slide plate 45 makes contact with the second fixed contact 27 while the biasing force is accumulated. As a consequence, the second movable contact can make contact with the second fixed contact in such a way that various motions such as motion for unbalancing the contact relationship, bounding, and chattering are suppressed.

Figure 7D:
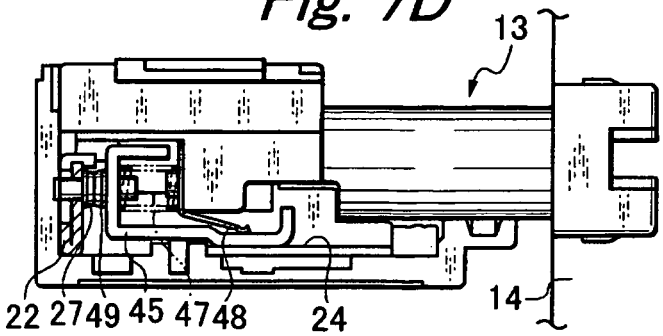
Figure 8A:
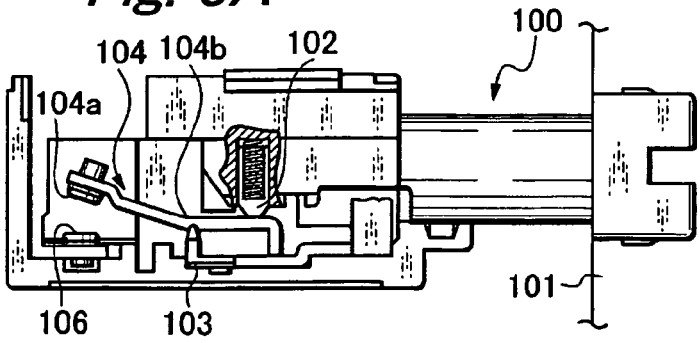
Fig. 8A PRIOR ART
Figure 8B:
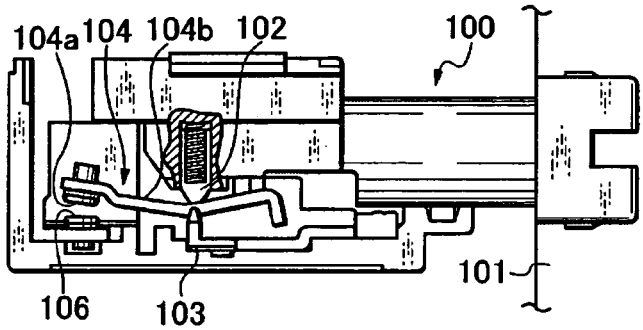
Fig. 8B PRIOR ART
Figure 8C:
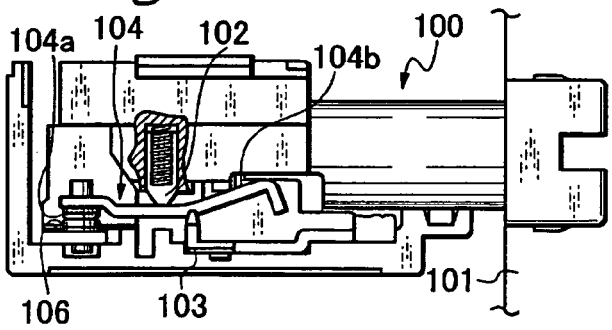
Fig. 8C PRIOR ART
Figure 8D:
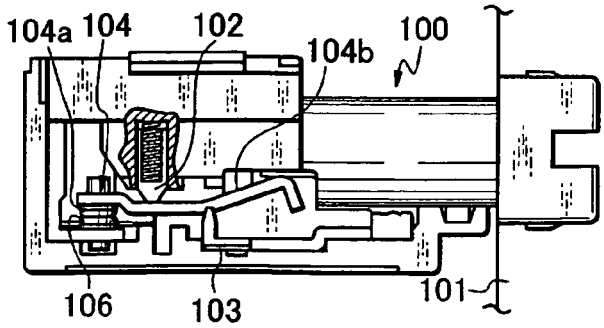
Fig. 8D PRIOR ART

Then, as shown in FIG. 7D, if the trigger button 14 interlocking with the trigger lever 13 is further pulled in, then only the lever 13 slidingly moves further in the leftward direction as viewed in the figure, compressing the slide spring 47 biasing the slide plate 45. The pressure applied by the second movable contact 49 to the second fixed contact 27 is increased accordingly. This further stabilizes the condition of contact.

This is a so-called full stroke condition. In this state, electric power supplied to the motor can be maximized in a state of switching on of the power supply circuit When the trigger button 14 is ceased to be pulled in, the trigger lever moves in the reverse direction. The contacts are disengaged from each other. The initial condition shown in FIG. 7A is regained.

As described above, the present invention is utilized as a switch for use with an electric power tool that is free from disadvantages such as wear due to contact.

What is claimed is:

1. A switch for use with an electric power tool having a grip portion in which a trigger switch is disposed, the electric power tool further including an electric motor;

wherein said trigger switch includes an insulative enclosure, first contacts for turning on and off the motor, second contacts for turning on and off a speed controller, a trigger lever having one end located outside the insulative enclosure, and a trigger button mounted at said one end of the trigger lever, said insulative enclosure including a boxlike chassis and a cover mounted over an open side of the chassis and closing off the open side, said trigger lever making sliding motion to turn on and off the first and second contacts;

wherein the first contacts, the second contacts, and the trigger lever are arranged in the insulative enclosure;

wherein plural conductive plates including first and second conductive plates are mounted and disposed in the chassis of the insulative enclosure;

wherein said first contacts for turning on and off the motor are formed by a first fixed contact and a first movable contact located opposite to the first fixed contact that is mounted on the second conductive plate, the first fixed contact being disposed to face the open side of the chassis, the first movable contact being mounted on one movable contact plate swingably supported;

wherein said second contacts for turning on and off the speed controller are formed by a second fixed contact and a second movable contact located opposite to the second fixed contact that is mounted on the first conductive plate, the second fixed contact being disposed in a direction perpendicular to the open side, the second movable contact being mounted near a front end of a slidably supported slide plate that is mounted to the trigger lever;

wherein a third conductive plate is mounted in the chassis and has a small support member disposed thereon, the support member supporting the movable contact plate;

wherein a fourth conductive plate is mounted in the chassis and has a sliding plate portion disposed thereon;

wherein said second fixed contact and said sliding plate portion are arranged parallel to said first fixed contact and said support member;

wherein said trigger lever covers the movable contact plate and the sliding plate portion after being inserted through an opening in the chassis, is located among the movable contact plate, the sliding plate portion, and the cover, and is capable of sliding along an open side of the chassis;

wherein said slide plate has a front-end portion coming into contact with the sliding plate portion, the second movable contact being mounted on the front-end portion, the slide plate being mounted by applying biasing force in a sliding direction and in a direction in which the slide plate comes into abutment with the sliding plate portion; and wherein a slider sliding on the movable contact plate and swinging the movable contact plate is mounted in a position adjacent to the slide plate.

* * * * *